US006584786B2

(12) United States Patent
Tavolazzi

(10) Patent No.: US 6,584,786 B2
(45) Date of Patent: Jul. 1, 2003

(54) FOOD PRESERVATION REFRIGERATOR CLOSURE MEMBER CARRYING AN INTERFACE FOR CONTROLLING ITS OPERATION

(76) Inventor: Stefano Tavolazzi, Vaile S. Giuseppe 45, Verbania-Intra (IT), 28921

( * ) Notice: Subject to any disclaimer, the term of this patent is extended or adjusted under 35 U.S.C. 154(b) by 36 days.

(21) Appl. No.: 09/843,401

(22) Filed: Apr. 26, 2001

(65) Prior Publication Data

US 2001/0039805 A1 Nov. 15, 2001

(30) Foreign Application Priority Data

May 5, 2000 (IT) ..... MI000269 U

(51) Int. Cl.[7] ..... F25B 49/02
(52) U.S. Cl. ..... 62/125; 236/51
(58) Field of Search ..... 62/125, 126, 127, 62/129, 130, 298; 236/51, 94; 165/11.1

(56) References Cited

U.S. PATENT DOCUMENTS 4,490,986 A * 1/1985 Paddock
5,114,070 A * 5/1992 Lilja et al. ..... 236/51 X
5,390,206 A * 2/1995 Rein et al. ..... 236/51 X
5,421,247 A * 6/1995 Shim ..... 99/468
5,595,342 A * 1/1997 McNair et al. ..... 236/51
5,810,245 A * 9/1998 Heitman et al. ..... 236/51 X
6,152,375 A * 11/2000 Robison ..... 236/51

FOREIGN PATENT DOCUMENTS

| | | | |
|---|---|---|---|
| DE | 19753669 A1 | 4/1998 | ..... F25D/29/00 |
| DE | 19916379 A1 | 2/1999 | ..... F25D/25/00 |
| DE | 19856031 A1 | 8/2000 | ..... D06F/33/02 |
| FR | 2693258 A1 | 7/1994 | ..... F25B/49/02 |

OTHER PUBLICATIONS

European Search Report EPO 10 9130 Dated Sep. 6, 2001.

* cited by examiner

*Primary Examiner*—Harry B. Tanner
(74) *Attorney, Agent, or Firm*—Robert O. Rice; Stephen Krefman; Thomas J. Roth

(57) ABSTRACT

A food preservation refrigerator such as an upright refrigerator or a chest freezer comprises at least one food preservation compartment on which at least one corresponding closure member is provided, said refrigerator comprising a refrigeration circuit, driver means for controlling the operation of this latter and means for controlling the operation of any accessory user items provided in the refrigerator, such as an ice producer, ice cream maker or the like, said control means being associated with a user interface; this latter is positioned on the closure member. Remote connection means are provided to enable said driver means positioned on the user interface to control the various refrigerator components.

24 Claims, 1 Drawing Sheet

FOOD PRESERVATION REFRIGERATOR CLOSURE MEMBER CARRYING AN INTERFACE FOR CONTROLLING ITS OPERATION

BACKGROUND OF THE INVENTION

1. Field of the Invention

The present invention relates to a food preservation refrigerator in accordance with the introduction to the main claim.

2. Description of the Related Art

The term "refrigerator" means any household electrical appliance able to preserve food, either at a temperature higher than 0° C. (the usual refrigerator) or at a temperature lower than 0° C. (freezer). Refrigerators present at least one food preservation compartment provided within a refrigerator cabinet on which there is positioned at least one corresponding closure member or door. On this latter or within the preservation compartment there can be provided further accessory user items such as an ice producer, a drink dispenser, an ice cream maker, a maker or the like.

The refrigerator also comprises a known refrigeration circuit presenting, in particular, a refrigerant fluid compressor and at least one defrosting resistance element positioned at an evaporator. In the aforesaid refrigerator there can also be provided at least one ventilation member, depending on the type of refrigerator.

All the members of the refrigeration circuit and the various refrigerator user items are controlled by control means (known per se, such as a thermostat, a microprocessor unit or the like) arranged to maintain within the preservation compartment those temperature characteristics set by the user via an interface provided with control means, said means also controlling the proper operation of the aforestated accessory user items. The user interface can comprise pushbuttons, knobs or displays to enable the control means to be operated and/or set and to display data such as confirmation of implementation of the command, data relative to the operation of the refrigerator or freezer (temperature of its preservation compartment, rapid freezing function activated, etc.), and other data relative to the functioning or operability of the accessory user items.

Finally it is known that the refrigerator closure member or, in particular, door can be mounted to open in a clockwise or anti-clockwise direction (i.e. with "reversible" opening) depending on requirements, for example deriving from building the refrigerator into a kitchen unit.

With particular but not exclusive reference to upright refrigerators, refrigerators are known having their user interface at least partly provided on the face of their door. These interfaces comprise operating means for the various members and user items of the refrigerator and can also at least partly comprise control means for these members. The interfaces are therefore connected to the refrigerator members or to control means for these latter present within the refrigerator cabinet, via electric cables through which electrical operating or control signals pass. These cables are generally present along that side of the cabinet on which the usual door opening hinge is positioned, they being fixed in this position, to hence compel the door to be mounted so that it opens in a particular direction on the refrigerator cabinet. The result is that the aforesaid arrangement in which the interface is provided on the door is of limited use.

In addition, the presence of electric current at main voltage within that part in which the operating means for the various refrigerator members are powered can produce safety problems in using the known arrangement, whether the door is closed or open.

SUMMARY OF THE INVENTION

An object of the present invention is to provide a refrigerator which is improved compared with known arrangements.

A further object is to provide a refrigerator of the aforesaid type which is safe for the user, and enables this latter to receive all information regarding the refrigerator operation without having to gain access to its interior.

These and further objects which will be apparent to the expert of the art are attained by a refrigerator in accordance with the accompanying claims.

BRIEF DESCRIPTION OF THE DRAWINGS

The present invention will be better understood from the accompanying drawing, which is provided by way of non-limiting example and in which.

DESCRIPTION OF THE PREFERRED EMBODIMENT

Figure 1:
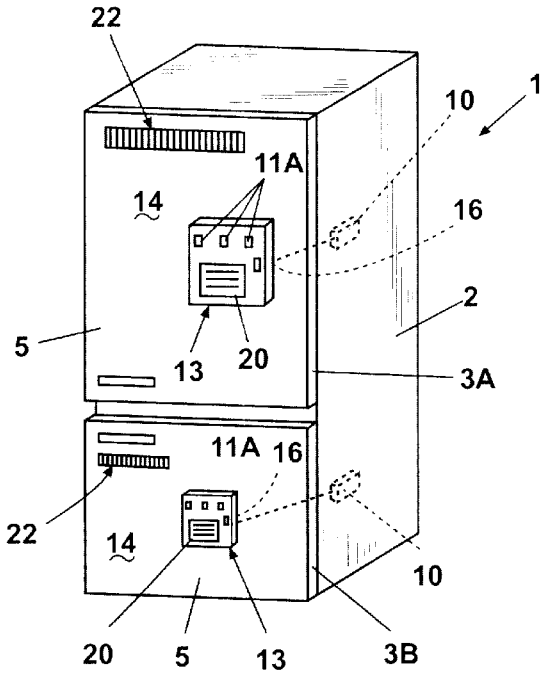
FIG. 1 is a front perspective view of an upright refrigerator according to the invention.

With reference to the said figures, an upright refrigerator is indicated overall by 1 and comprises a refrigerator cabinet 2 in which there is provided at least one food preservation compartment 3 (in FIG. 1 the refrigerator 1 comprises two preservation compartments at different temperatures, for example a refrigeration compartment 3A and a freezer refrigeration 3B). On an aperture 4 of the refrigeration 3 there is positioned a door 5 hinged at 6 to the cabinet 2.

Figure 2:
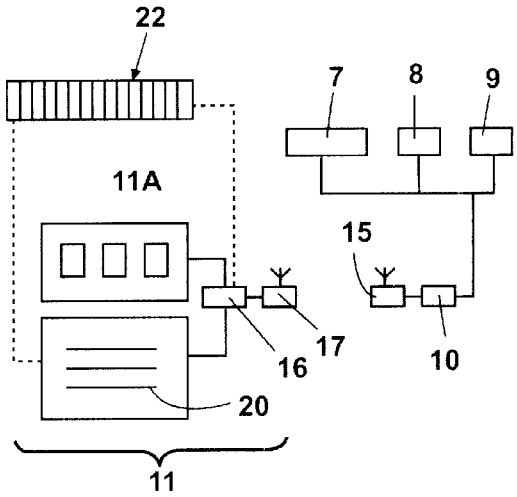
FIG. 2 is a block diagram of a part of the refrigerator of FIG. 1.

The refrigerator 1 comprises, in known manner, a refrigeration circuit 7 and accessory user items 8 and 9 such as a yoghurt maker and an ice-cream maker; this circuit and the accessory user items are shown schematically in FIG. 2.

The refrigerator 1 also comprises known means 10 for controlling the operation of the circuit 7 and user items 8 and 9; these means 10, schematically represented in FIGS. 1 and 2, can be for example a control circuit preferably of microprocessor type acting on power supplies or on the actuator members operating the accessory user items. The control means 10 are driven in their turn by driver means 11 provided on a user interface 13 positioned on a front side 14 (with reference to FIG. 1) of the door 5. The means 11 drive the means 10 connected to the members located in the compartment 3 corresponding to that door; the means 11 can also be positioned on a single door 5 even if the refrigerator comprises more than one compartment with corresponding doors. In that case said means 11 can control the operation of a plurality of user items positioned in various compartments of the refrigerator and hence control the entire refrigerator operation.

The means 11 comprise a plurality of pushbuttons or knobs 11A, or other equivalent control members, and are connected to a command receiver member 16, for example a microprocessor circuit, arranged to transfer the received information to the control means 10, for example for the purpose of closing a switch for activating the compressor 7.

According to the invention, the connection between the means 11 and 12 to enable "dialogue" between these latter is made without any electric cable connecting together said means, communication between these latter being remote; for example the communication can be via infrared, ultrasound, induction, radiofrequency or other remote communication systems, which operate in known manner without cable. For this purpose, said means 10 and 11 are connected to corresponding signal reception/transmission members 15 and 17; the first member 15 is associated with the cabinet 2, whereas the second is associated with the door 5.

The driver means 11 are also connected, in the embodiment shown in the figures, to a display unit 20, for example a liquid crystal display, again positioned on the door 5 and arranged to display to the user the operating state of the refrigerator, the temperature of each compartment 3 and other information useful in aiding the utilization of the refrigerator (for example whether any shelves in the compartment 3 are free, or whether any products are close to their expiry date). The display unit 20 can also be of the touch screen type and can also dialogue remotely with a telephone network to receive possible data and commands from it and feed them along it.

Figure 3:
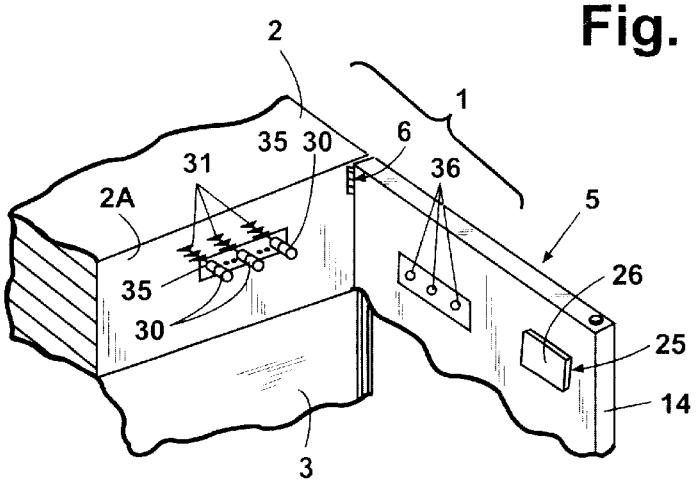
FIG. 3 is a perspective view of part of a variant of FIG. 1 in the open position.

Electrical power to the user interface 13 is preferably provided by a rechargeable battery fed by a photovoltaic cell panel 22 positioned on the side 14 of the door 5. This enables the various members of the interface 13 to be powered self-sufficiently without the need for connection to the main supply in the room in which the refrigerator is positioned. As an alternative or in addition to this arrangement, the door 5 can be provided (see FIG. 3) with a seat 25 with its own opening cover 26 for fry cells, or the interface 13 can be powered directly from the panel 22 or, again, this latter could be dispensed with and the rechargeable batteries be removably associated with the door 5 (for example be placed in the seat 25) so that they can be extracted and recharged. In this case the interface 13 comprises a buffer battery enabling the members provided on said interface to operate for the whole of the time required for recharging the batteries, or alternatively said interface can be provided with a non-volatile memory.

According to a variant (FIG. 3), the rechargeable battery or batteries can receive power from the electric main each time the door 5 is closed on the cabinet 2. This is achieved via movable contacts 30 associated with a front part 2A of the cabinet 2. The contacts 30 are subjected to the thrust of elastic elements 31 which urge said contacts out of seats 35 provided in said part 2A when the door 5 is opened, but which enable said contacts to re-enter said seats when the door is closed, to receive power from a usual low voltage electrical line present in the cabinet 2. With the door closed, the contacts 30 cooperate with fixed contacts 36 provided on the door 5 and connected to the rechargeable battery, said cooperation enabling this latter to be powered and continuously recharged.

The contacts 35 (this time fixed) could instead be provided on the inner part of the door 5, whereas in the part 2A of the cabinet 2 seats are provided into which said contacts penetrate when the door is closed, in order to receive power from the electrical line embedded in the cabinet 2.

By virtue of the invention a refrigerator is obtained which, on the outside of its door, carries an interface comprising the refrigerator operating controls and providing information on the state of this operation, on the utilization of the refrigerator or on the amount of food or the like located inside it. All this is achieved while enabling the door to be mounted reversibly on the refrigerator cabinet.

Moreover, the invention enables the level of electrical voltage present within the door to be at least limited in order to achieve safe utilization of the refrigerator.

It should be noted that if communication between the means 10 and 11 is interrupted, for example because a foreign body becomes interposed between the members 15 and 17, the means 10 are arranged to operate in accordance with a predetermined standard such as to maintain within the refrigerator or within the accessory user items present therein the minimum conditions necessary to prevent damage to the contained products.

Although the present invention has been described with reference to specific embodiments, those of skill in the Art will recognize that changes may be made thereto without departing from the scope and spirit of the invention as set forth in the appended claims.

I claim:

1. A food preservation refrigerator, said refrigerator comprising:

a refrigerator cabinet in which there is provided at least one food preservation compartment provided with its own closure member, the closure member being configured to be reversibly mountable on the cabinet such that the closure member can be mounted to open in either a clockwise or counter-clockwise direction, a refrigeration circuit or controlling one or more components of the refrigerator including a compressor, control means being provided to control the operation of the components of the refrigeration circuit, driver means for controlling said control means, the driver means comprising control members associated with an interface present on one side of the closure member and accessible by a user from outside the refrigerator, and wherein a remote wireless connection enables the driver means to dialog with and intervene on the control mean in order to control the operation of the various refrigerator components.

2. A refrigerator as claimed in claim 1, further comprising accessory user items including an ice maker wherein the control means and driver means operate to control the accessory user items.

3. A refrigerator as claimed in claim 1, wherein the interface is electrically powered by a power member associated with the closure member.

4. A refrigerator as claimed in claim 3, wherein the power member is at least one electrical storage battery.

5. A refrigerator as claimed in claim 4, wherein the storage battery is at least one rechargeable battery.

6. A refrigerator as claimed in claim 5, further comprising a panel of solar cells associated with the closure member to enable the rechargeable battery to be continuously recharged.

7. A refrigerator as claimed in claim 4, comprising a first connector means associated with the refrigerator cabinet and cooperating, when the member is closed onto the cabinet, with a corresponding second connector means associated with the closure member, the first connector means, associated with the cabinet, being connected to an electrical power unit connected to the main, whereas the second connector means, associated with the closure member, are connected to the battery.

8. A refrigerator as claimed in claim 7, wherein the first connector means are projecting contacts and the second connector means are flat or hollowed contacts.

9. A refrigerator as claimed in claim 3, wherein the electrical storage battery is a dry cell.

10. A refrigerator as claimed in claim 1, wherein the remote connection means are at least two members for transmitting/receiving infrared rays, a first member being connected to the driver means and the second member being connected to the control means.

11. A refrigerator as claimed in claim 1, wherein the remote connection means are at least two members for transmitting/receiving ultrasound, a first member being connected to the driver means and the second member being connected to the control means.

12. A refrigerator as claimed in claim 1, wherein the remote connection means are at least two members for transmitting/receiving radio waves, a first member being connected to the driver means and the second member being connected to the control means.

13. A refrigerator as claimed in claim 1, wherein the remote connection means are induction members, each connected to a corresponding driver means and control means.

14. A refrigerator as claimed in claim 1, wherein the driver means and control means are microprocessor circuits.

15. A refrigerator as claimed in claim 1, wherein a display unit is present on the interface.

16. A refrigerator as claimed in claim 15, wherein the display unit comprises a screen preferably of liquid crystal touch-screen type.

17. A refrigerator as claimed in claim 1, wherein the driver means are connected to a telephone line.

18. A food preservation refrigerator, the refrigerator comprising:

a refrigerator cabinet in which there is provided at least one food preservation compartment provided with a closure member pivotably supported on the cabinet for selectively closing the at least one preservation compartment, the closure member being configured to be reversibly mountable on the cabinet such that the closure member can be mounted to open in either a clockwise or counter-clockwise direction, a refrigeration circuit for controlling one or more components of the refrigerator including a compressor, control means being provided to control the operation of the components of the refrigeration circuit, the control means being supported on the cabinet, and driver means for controlling said control means, the driver means being supported on the closure member and including user interface elements present on one side of the closure member and accessible by a user from outside the refrigerator, wherein the driver means and the control means communicate with each other via remote, wireless communication means.

19. A refrigerator as claimed in claim 18, wherein the user interface is electrically powered by at least one electrical storage battery associated with the closure member.

20. A refrigerator as claimed in claim 19, further comprising:

a panel of solar cells associated with the closure member for continuously recharging the battery.

21. A refrigerator as claimed in claim 18, further comprising:

a first connector means associated with the refrigerator cabinet, and a second connector means associated with the closure member, the first connector means cooperating, when the closure member is closed onto the cabinet, with corresponding second connector means, the first connector means being connected to an electrical power unit connected to the main and the second connector means being connected to the battery.

22. A refrigerator as claimed in claim 21, wherein the first connector means are projecting contacts and the second connector means are flat or hollowed contacts.

23. A refrigerator as claimed in claim 18, further comprising at least two members for transmitting/receiving infrared rays, a first member being connected to the driver means and the second member being connected to the control means.

24. A refrigerator as claimed in claim 18, further comprising at least two members for transmitting/receiving ultrasound, a first member being connected to the driver means and the second member being connected to the control means.

* * * * *